US011331706B2

(12) United States Patent
Nojima et al.

(10) Patent No.: US 11,331,706 B2
(45) Date of Patent: May 17, 2022

(54) WIRE ROD FORMING MACHINE

(71) Applicant: ASAHI-SEIKI MANUFACTURING CO., LTD., Owariasahi (JP)

(72) Inventors: Takashi Nojima, Nagoya (JP); Shingo Tada, Tokyo-to (JP)

(73) Assignee: ASAHI-SEIKI MANUFACTURING CO., LTD., Owariasahi (JP)

( * ) Notice: Subject to any disclaimer, the term of this patent is extended or adjusted under 35 U.S.C. 154(b) by 0 days.

(21) Appl. No.: 16/944,661

(22) Filed: Jul. 31, 2020

(65) Prior Publication Data

US 2021/0170462 A1 Jun. 10, 2021

(30) Foreign Application Priority Data

Dec. 6, 2019 (JP) ..... JP2019-221069

(51) Int. Cl.

| | |
|---|---|
| ***B21F 3/02*** | (2006.01) |
| ***B21C 1/02*** | (2006.01) |
| ***B21F 3/04*** | (2006.01) |

(52) U.S. Cl.

CPC . *B21C 1/02* (2013.01); *B21F 3/04* (2013.01)

(58) Field of Classification Search

CPC ..... B21F 3/02; B21F 3/04; B21F 3/06; B21F 3/04; B21F 1/008; B21F 1/006; B21D 11/06; B21D 11/07

See application file for complete search history.

(56) References Cited

U.S. PATENT DOCUMENTS

| | | | |
|---|---|---|---|
| 5,937,685 | A | 8/1999 | Matsuoka et al. |
| 7,024,901 | B2 | 4/2006 | Yamaguchi et al. |
| 8,166,786 | B2 | 5/2012 | Speck |
| 8,336,353 | B2 | 12/2012 | Tsuritani |
| 8,573,014 | B2 | 11/2013 | Tsuritani |

(Continued)

FOREIGN PATENT DOCUMENTS

| | | | |
|---|---|---|---|
| CN | 1171309 | A | 1/1998 |
| CN | 1520949 | A | 8/2004 |

(Continued)

OTHER PUBLICATIONS

Mar. 16, 2020 Japanese Grant Decision issued in Japanese Patent Application No. 2019-221069.

(Continued)

*Primary Examiner* — Debra M Sullivan

(74) *Attorney, Agent, or Firm* — Oliff PLC

(57) ABSTRACT

A wire rod forming machine according to the present disclosure includes: a base plate including a vertical first basal surface on its front side; a quill projecting from the first basal surface; a wire rod guide hole penetrating through the quill; a wire rod feeding apparatus provided on a rear side of the base plate; a first XY table; an extending supporting part including a second basal surface perpendicular to the first basal surface; and a second XY table provided at the second basal surface of the extending supporting part. The first XY table includes a slide plate having a recessed part configured to receive the quill. The slide plate is provided with a plurality of apparatus fixing parts configured to fix a plurality of first tool shifting apparatuses arranged radially about the recessed part. The second XY table includes a second tool shifting apparatus.

17 Claims, 10 Drawing Sheets

(56) References Cited

U.S. PATENT DOCUMENTS

| | | | | |
|---|---|---|---|---|
| 10,286,435 | B2 | 5/2019 | Nojima et al. | |
| 2005/0044914 | A1 | 3/2005 | Kao | |
| 2009/0007619 | A1 | 1/2009 | Speck | |
| 2016/0332212 | A1* | 11/2016 | Yang | B21F 1/008 |
| 2019/0001386 | A1* | 1/2019 | Nojima | B21D 11/00 |

FOREIGN PATENT DOCUMENTS

| | | | |
|---|---|---|---|
| CN | 205519402 | U | 8/2016 |
| CN | 205613989 | U | 10/2016 |
| CN | 208913041 | U | 5/2019 |
| DE | 202015104341 | U1 | 9/2015 |
| JP | 2007-030038 | A | 2/2007 |
| JP | 2009-160633 | A | 7/2009 |
| JP | 2011098389 | A | 5/2011 |
| JP | 4890508 | B2 | 3/2012 |
| JP | 2013107103 | A | 6/2013 |
| JP | 5325369 | B2 | 10/2013 |
| JP | 5682966 | B2 | 3/2015 |
| JP | 3201031 | U | 11/2015 |
| JP | 2019005801 | A | 1/2019 |
| JP | 6682171 | B1 | 4/2020 |
| TW | 200906515 | A | 2/2009 |
| TW | M560349 | U | 5/2018 |

OTHER PUBLICATIONS

Dec. 6, 2019 Japanese Patent Certificate issued in Japanese Patent Application No. 2019-221069.

Nov. 26, 2020 Office Action issued in Taiwanese Patent Application No. 109129241.

Feb. 2, 2021 Chinese Office Action issued in Chinese Patent Application No. 202010846247.0.

Mar. 3, 2021 Extended European Search Report issued in European Patent Application No. 20192625.0.

Jan. 17, 2022 Office Action issued in European Application 20 192 625.0.

* cited by examiner

WIRE ROD FORMING MACHINE

BACKGROUND OF THE INVENTION

(1) Field of the Invention

The present disclosure relates to a wire rod forming machine that forms, with a plurality of tools, a wire rod fed through a quill.

(2) Description of Related Art

A conventionally known wire rod forming machine of this type includes: a quill projecting from the central part in the front surface of an upright base plate; an extending supporting part extending from one side of the front surface of the base plate; and a mechanism provided on the extending supporting part for shifting tools (for example, see Japanese Unexamined Patent Application Publication No. JP 2019-5801 A).

A wire rod forming machine with a greater number of movable axes of the mechanism for shifting the tools exhibits improved versatility and provides a wider variety in the shape of the wire rod product. On the other hand, the increased number of movable axes increases the size of the whole wire rod forming machine and costs. Furthermore, the desired degree of versatility of a wire rod forming machine varies depending on the user of the wire rod forming machine.

SUMMARY OF THE INVENTION

In view of the circumstances, an object of the present disclosure is to provide the technique that makes it possible to readily change the number of movable axes of tools of a wire rod forming machine and to downsize the whole wire rod forming machine.

A wire rod forming machine according to one aspect of the present invention is a wire rod forming machine including: a base plate including a first basal surface on its front side, the first basal surface being vertical; a quill projecting from the first basal surface; a wire rod guide hole penetrating through the quill in a front-rear direction; a wire rod feeding apparatus provided on a rear side of the base plate and configured to feed the wire rod to the front side of the base plate through the wire rod guide hole; a first XY table mounted on the first basal surface and including an output part that shifts to any desired position in a first direction and a second direction being perpendicular to each other within a plane parallel to the first basal surface; a slide plate provided at the output part of the first XY table and being plate-like and parallel to the first basal surface, on one side relative to the quill in the first direction, the slide plate covering the first basal surface across one side and other side relative to the quill in the second direction, and on other side relative to the quill in the first direction, the slide plate not covering the first basal surface at least on the one side relative to the quill in the second direction, the slide plate including at one lateral part a recessed part configured to receive the quill in the first direction; a plurality of apparatus fixing parts configured to fix a plurality of first tool shifting apparatuses arranged radially about the recessed part to the slide plate, the first tool shifting apparatuses being configured to rotationally or linearly shift while holding tools; an extending supporting part fixed to a position on the other side relative to the quill in the first direction in the first basal surface and on the one side relative to the quill in the second direction, the extending supporting part including a second basal surface perpendicular to the first basal surface so as to be oriented in the other side in the second direction; a second XY table mounted on the second basal surface and including an output part configured to shift to any desired position in a plane parallel to the second basal surface; and a second tool shifting apparatus mounted on the output part of the second XY table and configured to rotationally or linearly shift while holding a tool.

DETAILED DESCRIPTION OF PREFERRED EMBODIMENT

Figure 1:
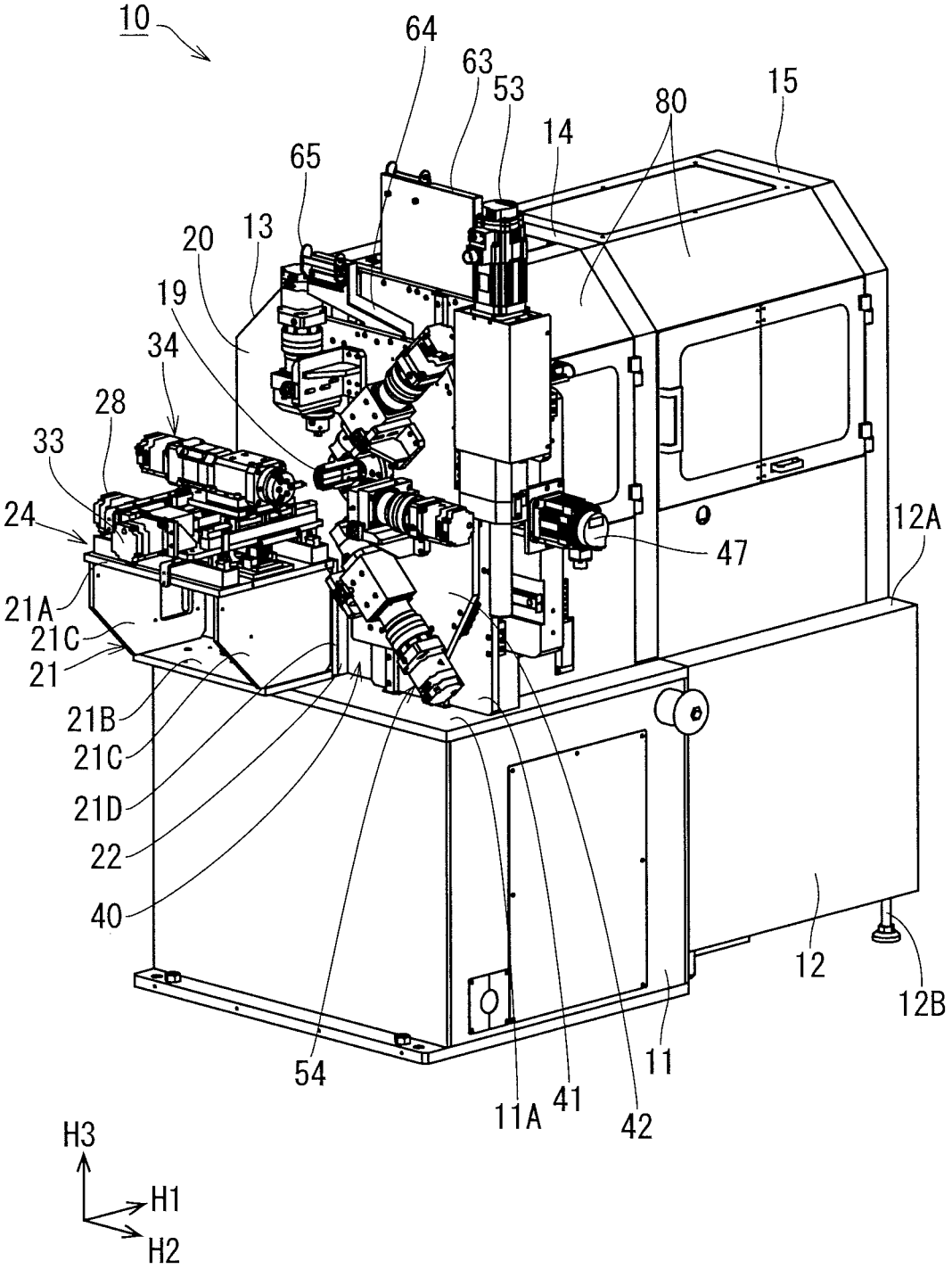
FIG. 1 is a perspective view of a wire rod forming machine according to an embodiment of the present disclosure.

In the following, with reference to FIGS. 1 to 10, a description will be given of an embodiment of a wire rod forming machine 10 of the present disclosure. As shown in FIG. 1, the wire rod forming machine 10 includes first and second mounts 11, 12 which are juxtaposed to each other. Hereinafter, the direction in which the first and second mounts 11, 12 are juxtaposed is referred to as "the front-rear direction H1". The side where the first mount 11 is disposed is referred to as "the front side", and its opposite side is referred to as "the rear side". The horizontal direction perpendicular to the front-rear direction H1 is referred to as the lateral direction H2. The right side in the lateral direction H2 when the wire rod forming machine 10 is seen from the front side is simply referred to as "the right side", and its opposite side is simply referred to as "the left side". The vertical direction is referred to as "the top-bottom direction H3".

The first and second mounts 11, 12 each have a box-like structure. Their respective upper surfaces 11A, 12A are disposed to be horizontal and flush to each other. The second mount 12 is fixed to the rear surface of the first mount 11. The lower surface of the second mount 12 is positioned higher than the lower surface of the first mount 11. The second mount 12 is supported from beneath by leg parts 12B extending downward from its lower surface.

At the upper surface 11A of the first mount 11, a base plate 13 and a first back plate 14 stand vertically. At the upper surface 12A of the second mount 12, a second back plate 15 stands vertically. The base plate 13 and the first and second back plates 14, 15 are parallel to the lateral direction H2.

Figure 9:
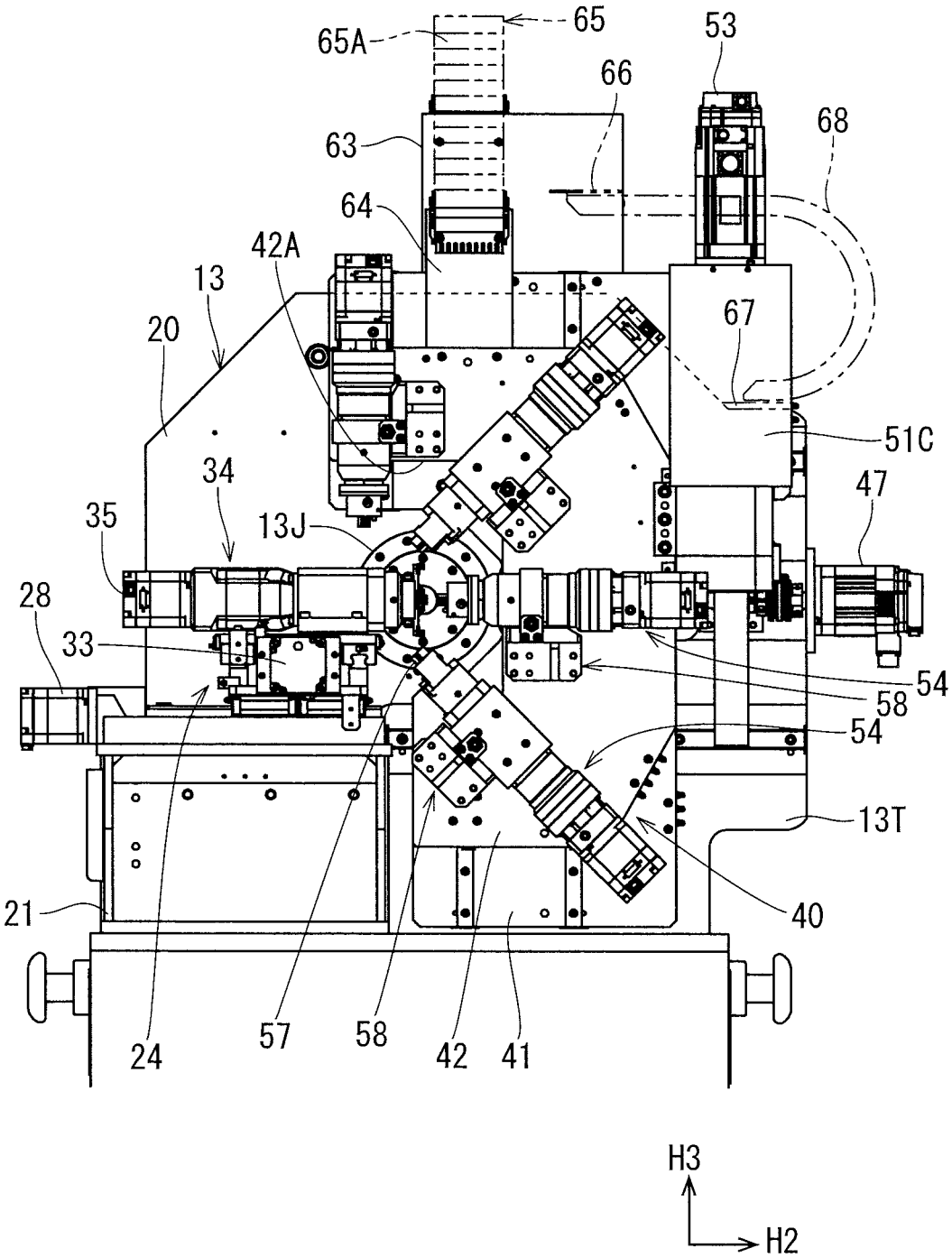
FIG. 9 is a partial front view of the wire rod forming machine.

Specifically, the first and second back plates 14, 15 each have a shape of a quadrangular plate member having both upper corners diagonally cut off. As shown in FIG. 9, the base plate 13 has a shape of a quadrangular plate member having both upper corners diagonally cut off. In the base plate 13, the range from the lower end of the inclined side of the upper right corner part to the position near the lower end of the right side is extended rightward, to form a lateral projecting part 13T.

As shown in FIG. 1, the base plate 13 is disposed on the frontward side in the upper surface 11A of the first mount 11. The first back plate 14 is disposed at the rear end of the upper surface 11A of the first mount 11. The second back plate 15 is disposed at the rear end of the upper surface 12A of the second mount 12. A cover 80 that is bent so as to conform to the outer edge shape of the first and second back plates 14, 15 covers the space between the base plate 13 and the first back plate 14 and the space between the first and second back plates 14, 15.

Figure 2:
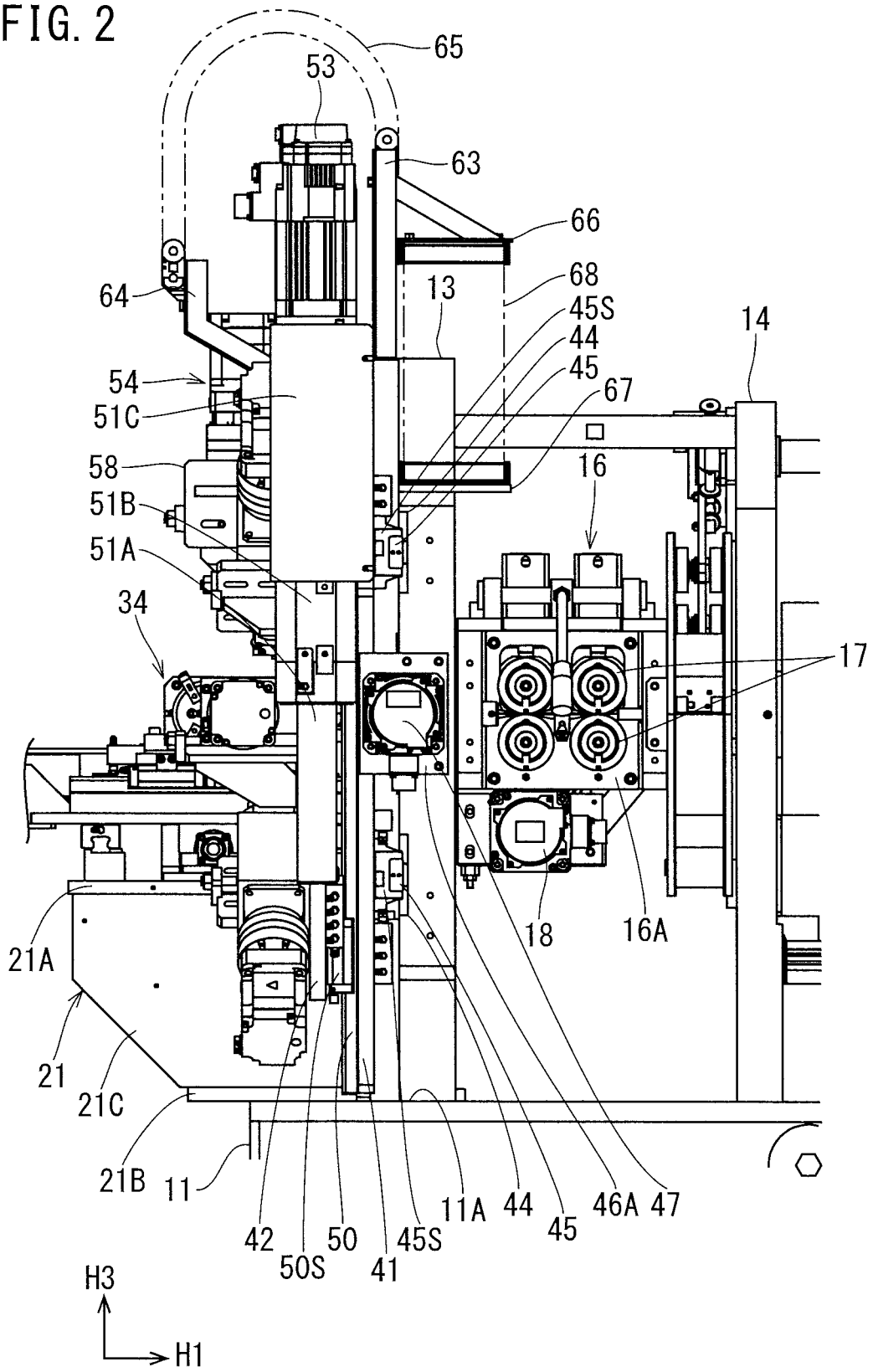
FIG. 2 is a partial side view of the wire rod forming machine.
Figure 5:
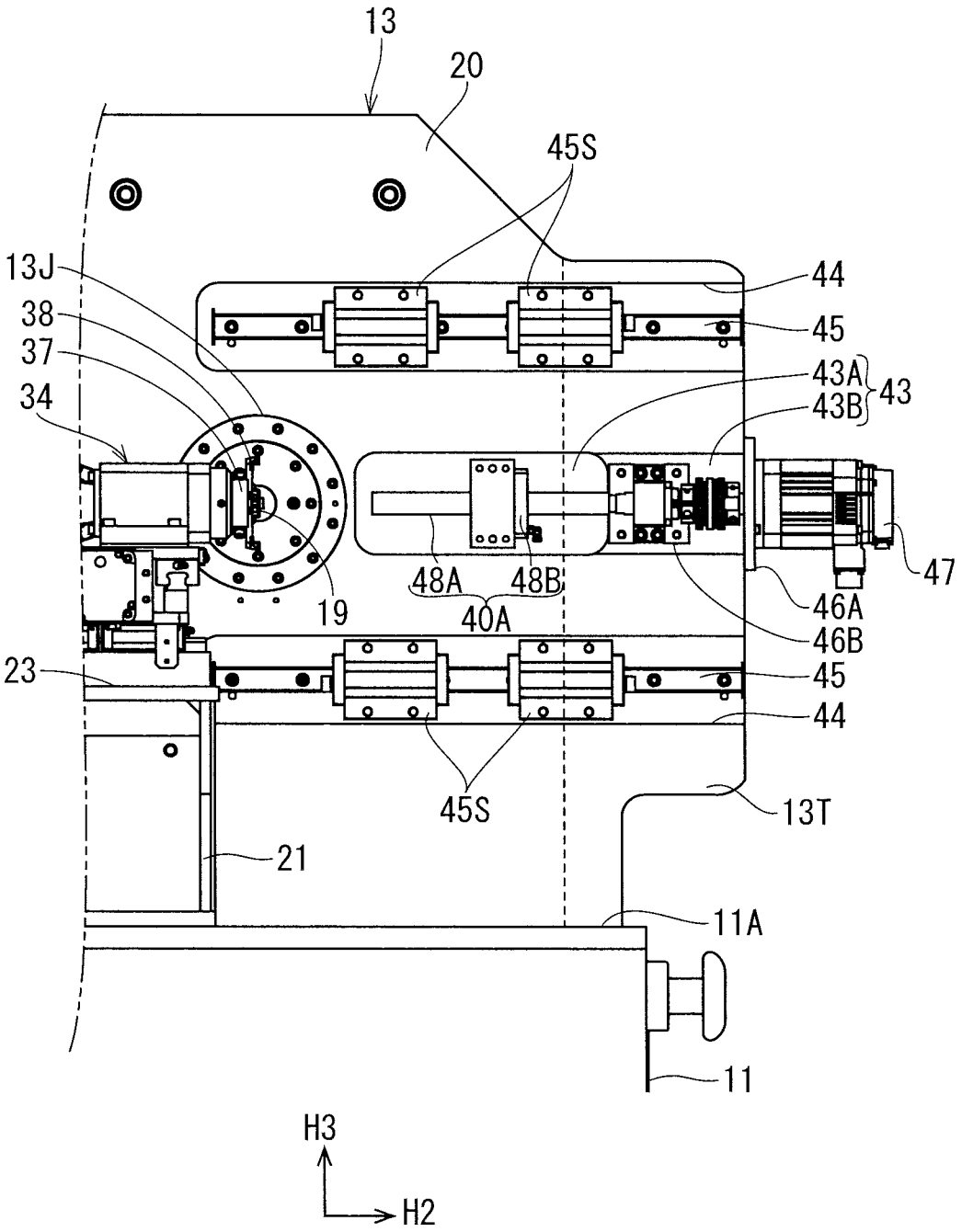
FIG. 5 is a partial front view of a base plate.

As shown in FIG. 2, between the base plate 13 and the first back plate 14, a wire rod feeding apparatus 16 is provided. The wire rod feeding apparatus 16 includes a base part 16A that rotatably supports two pairs of rollers 17, and a not-shown pair of rotary shaft parts extending frontward and rearward from the base part 16A. The pair of rotary shaft parts is disposed coaxially. At the center part of the rotary shaft parts, a wire rod guide hole configured to guide a wire rod 90 is formed. The pair of rotary shaft parts is rotatably supported by the base plate 13 and the first back plate 14. Note that, FIG. 5 shows a rotary support part 13J that rotatably supports the wire rod feeding apparatus 16 at the base plate 13.

As shown in FIG. 2, the wire rod 90 passed through the wire rod guide hole of the pair of rotary shaft parts is held between the two pairs of rollers 17. The rollers 17 driven by a servomotor 18 mounted on the base part 16A symmetrically rotate, to feed the wire rod 90 frontward.

The rear one of the rotary shaft parts projects rearward than the first back plate 14. This projecting portion is coupled with gears to a not-shown servomotor mounted on the rear surface side of the first back plate 14. Thus, the wire rod feeding apparatus 16 together with the wire rod 90 is position-controlled to any desired rotation position. Note that, while the wire rod feeding apparatus 16 according to the present embodiment is rotatable with a quill 19, which will be described later, about the wire rod feeding line, the wire rod feeding apparatus 16 may not be rotatable. Furthermore, while the wire rod 90 fed by the wire rod feeding apparatus 16 according to the present embodiment has a circular cross section, the wire rod 90 may have an oval or quadrangular cross section.

Figure 3:
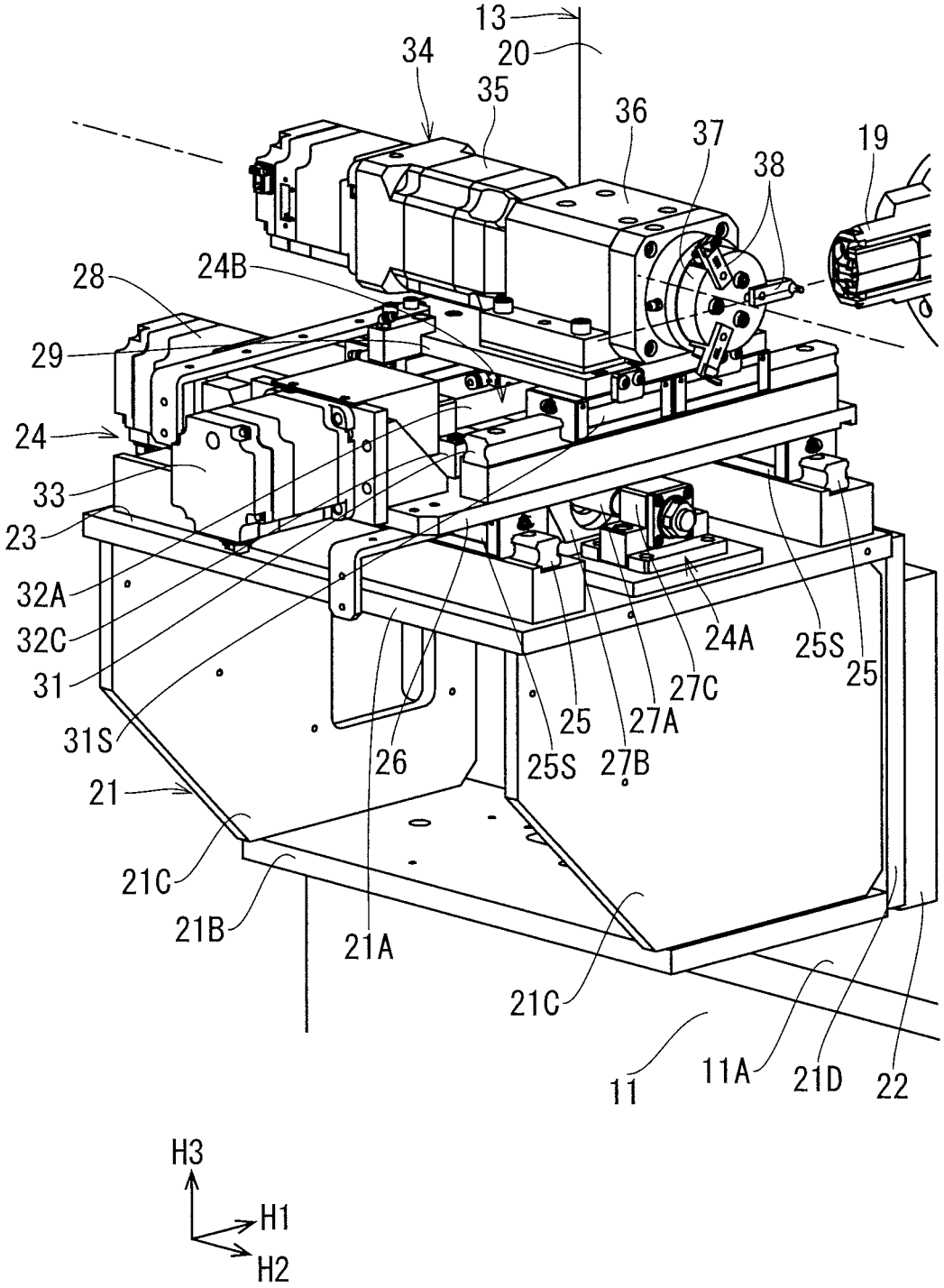
FIG. 3 is a perspective view of an extending supporting part.
Figure 4:
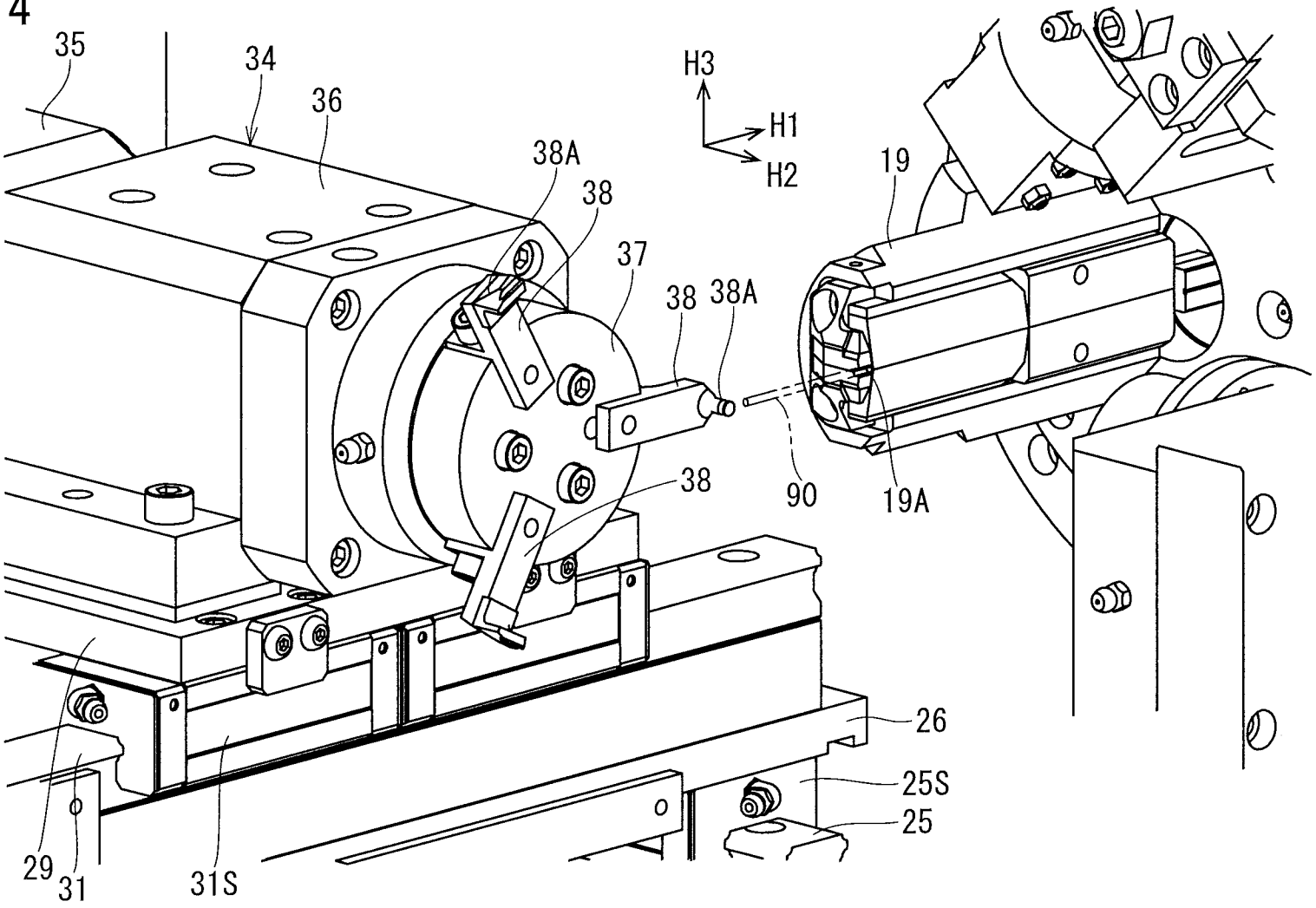
FIG. 4 is a perspective view of a second tool shifting apparatus and a quill.

To the front one of the rotary shaft parts of the wire rod feeding apparatus 16, the quill 19 shown in FIG. 3 is fixed so as to be integrally rotatable, and projects frontward from the base plate 13. As shown in FIG. 4, the quill 19 has a sector-shape cross section and extends on the extension of the rotary shaft part of the wire rod feeding apparatus 16. In the tip surface of the quill 19, the center portion of the sector projects at the forefront. The quill 19 includes a wire rod guide hole 19A that continuously extends from the rotary shaft part at the center portion of the sector. The wire rod 90 fed by the wire rod feeding apparatus 16 is sent frontward from the tip of the quill 19.

Note that, in the second back plate 15 shown in FIG. 1, a wire rod insert hole is formed coaxially to the rotary shaft part of the wire rod feeding apparatus 16. Through the wire rod insert hole, the wire rod 90 is delivered to the wire rod forming machine 10 from the rear side. Between the first and second back plates 14, 15, a not-shown correction mechanism that removes any bent from the wire rod 90 to correct the wire rod 90 straight is housed.

As shown in FIG. 1, the front surface of the base plate 13 functions as a first basal surface 20 on which an extending supporting part 21 and a first XY table 40, which will be described later, are mounted. The quill 19 is disposed at the central portion of the first basal surface 20. As used herein, "the central portion of the first basal surface 20" does not mean "the center portion of the first basal surface 20" or "the barycenter portion of the first basal surface 20", but "the portion excluding ends in the lateral direction H2 and the top-bottom direction H3 of the first basal surface 20". Note that, in the present embodiment, while the quill 19 is disposed at the position near the barycenter of the first basal surface 20, the quill 19 may be disposed at a position displaced from the barycenter in one or both of the lateral direction H2 and the top-bottom direction H3.

As shown in FIG. 3, the extending supporting part 21 is structured by, for example, an upper plate 21A, a lower plate 21B, a pair of side plates 21C, and a rear plate 21D welded to each other. The upper plate 21A and the lower plate 21B are identical to each other in size in the lateral direction H2, whereas the upper plate 21A is greater in size than the lower plate 21B in the front-rear direction H1. The rear end of the upper plate 21A and the rear end of the lower plate 21B are respectively abutted and welded to the upper and lower edges of the rear plate 21D, and the pair of side plates 21C is interposed in the top-bottom direction between the pair of side edges of the upper plate 21A and the lower plate 21B and welded in this state. The pair of side plates 21C has the front bottom corners diagonally cut off relative to the top-bottom direction H3, so that the upper edge becomes substantially identical in size to the upper plate 21A in the front-rear direction H1 and the lower edge becomes substantially identical in size to the lower plate 21B in the front-rear direction H1.

As shown in FIG. 9, the extending supporting part 21 is mounted on the lower left part of the first basal surface 20. Specifically, as shown in FIG. 3, on the lower left part of the first basal surface 20, a backup plate 22 being identical in shape to the rear plate 21D and greater in thickness than the rear plate 21D is overlaid and fixed by bolts. Onto the backup plate 22, the rear plate 21D of the extending supporting part 21 is overlaid and fixed by bolts. The lower surface of the backup plate 22 and the lower surface of the extending supporting part 21 are both overlaid on the upper surface 11A of the first mount 11. The lower plate 21B of the extending supporting part 21 is fixed to the upper surface 11A of the first mount 11 by bolts. The upper surface of the extending supporting part 21 functions as a second basal surface 23 which is perpendicular to the first basal surface 20 and horizontal.

As has been described above, the extending supporting part 21 according to the present embodiment has a housing structure. Here, so long as the extending supporting part 21 includes the second basal surface 23 perpendicular to the first basal surface 20, it may not have a housing structure. For example, the extending supporting part may be structured by a rear plate which is overlaid and fixed onto the first basal surface 20 by bolts, an upper plate perpendicular thereto, and a reinforcement rib connecting between the upper plate and the rear plate.

On the second basal surface 23, a second XY table 24 is mounted. The second XY table 24 includes: an intermediate table 26 that is shiftable to any desired position in the lateral direction H2 by a ball screw mechanism 24A provided between the intermediate table 26 and the second basal surface 23; and an output table 29 that is shiftable to any desired position in the front-rear direction H1 by a ball screw mechanism 24B provided between the output table 29 and the intermediate table 26. The output table 29 functions as the output part of the second XY table 24.

Specifically, to the second basal surface 23, a pair of support rails 25 extending in parallel to the lateral direction H2 is fixed. A plurality of sliders 25S fixed to the lower surface of the flat-plate like intermediate table 26 slidably engage with the pair of support rails 25. Furthermore, in the second basal surface 23, between the pair of support rails 25, a ball screw 27A extending in the lateral direction H2 in parallel to the support rails 25 is provided. The ball screw 27A has its both ends rotatably supported by a pair of rotary mounts 27C rising from the second basal surface 23. The ball screw 27A is driven to rotate by a servomotor 28 mounted on the extending supporting part 21. A ball nut 27B fixed to the lower surface of the intermediate table 26 screws with the ball screw 27A, to structure the ball screw mechanism 24A.

To the upper surface of the intermediate table 26, a pair of support rails 31 extending in parallel to the front-rear direction H1 is fixed. A ball screw 32A extending in the front-rear direction H1 is rotatably supported by a pair of rotary mounts 32C rising from the intermediate table 26 and disposed between the pair of support rails 31. The ball screw 32A is driven to rotate by a servomotor 33 mounted on the intermediate table 26. A plurality of sliders 31S fixed to the lower surface of the output table 29 slidably engage with the pair of support rails 31. A ball nut (not shown) fixed to the lower surface of the output table 29 screws with the ball screw 32A, to structure the ball screw mechanism 24B.

In the second XY table 24 according to the present embodiment, while two movable axes are implemented as the ball screw mechanisms 24A, 24B, one or both of the movable axes may be implemented as a mechanism other than the ball screw mechanism. The mechanism other than the ball screw mechanism may be a rack and pinion, or a structure including a pair of pulleys or a pair of sprockets and a belt or a chain disposed across the pulleys or the sprockets, in which the belt or the chain is fixed to the intermediate table 26 or the output table 29. The same holds true to the first XY table 40 which will be described later.

To the output table 29, a second tool shifting apparatus 34 is mounted. The second tool shifting apparatus 34 includes a deceleration mechanism part 36 provided at one end of the servomotor 35, and a circular rotary table 37 fixed to the output rotary part of the deceleration mechanism part 36. The second tool shifting apparatus 34 is fixed to the output table 29 such that the rotation center of the rotary table 37 becomes parallel to the lateral direction H2. On the rotary table 37, a plurality of tools 38 are mounted at positions equally dividing the rotary table 37 about the central axis. The tools 38 extend in the radial direction of the rotary table 37 and project laterally from the rotary table 37. As shown in FIG. 4, from the tip of each tool 38, a protruding part 38A protrudes in the rotary axis direction of the rotary table 37. Thus, the protruding part 38A is caused to abut on the wire rod 90 delivered from the quill 19, to form a wire rod product.

Note that, while the wire rod forming machine 10 according to the present embodiment includes one second tool shifting apparatus 34 at the output table 29, a plurality of second tool shifting apparatuses 34 may be included. Furthermore, the second tool shifting apparatus 34 may include, for example, a plurality of servomotors so as to separately drive a plurality of tools. More specifically, the second tool shifting apparatus 34 may include two servomotors and separately drive two tools of a pair, so that the wire rod 90 held between the pair of tools is cut or bent. Furthermore, as disclosed in JP 2019-5801 A, the second tool shifting apparatus 34 may include three servomotors.

Figure 8:
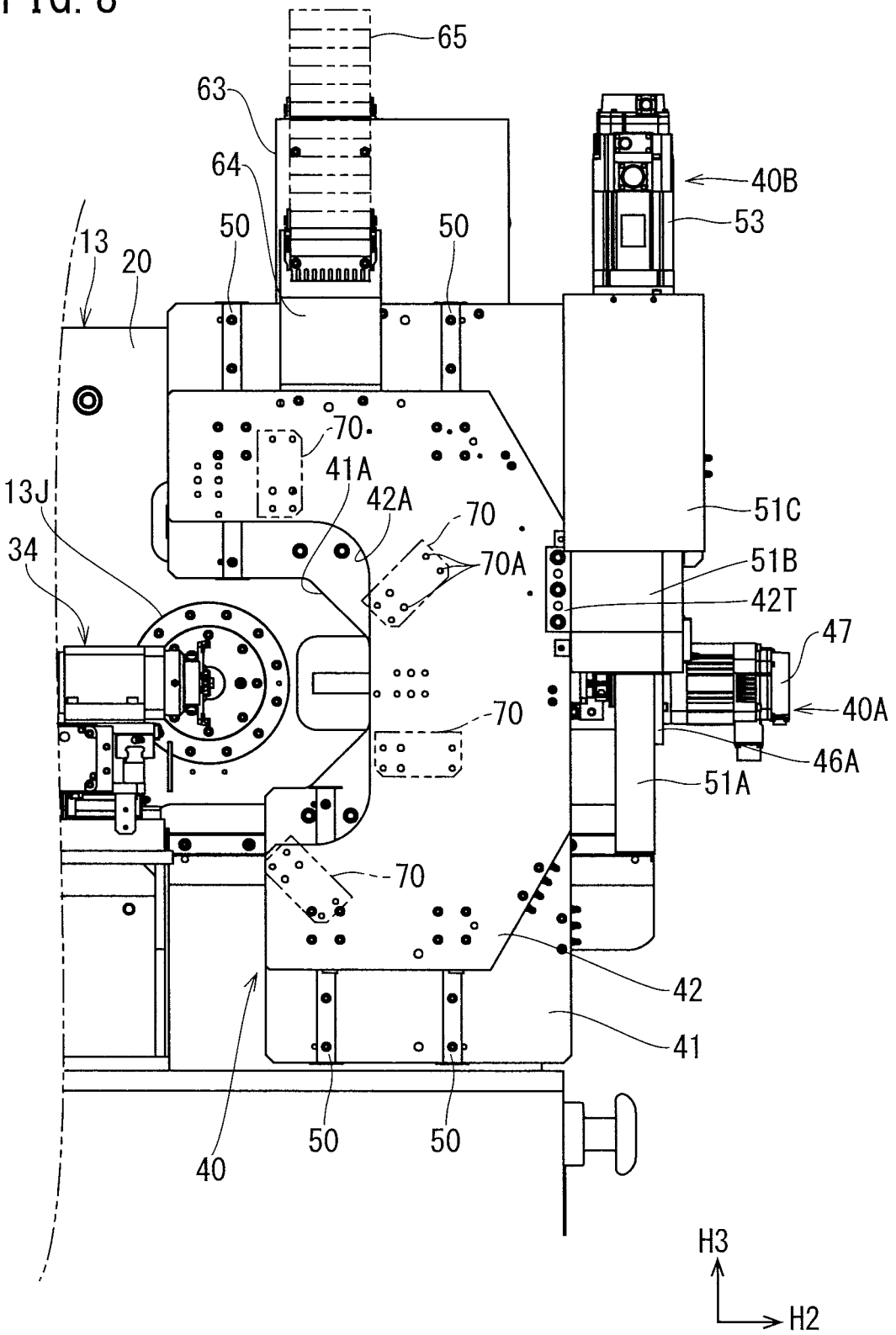
FIG. 8 is a front view of the slide plate.

As shown in FIG. 8, the first XY table 40 includes: an intermediate plate 41 that is shiftable to any desired position in the lateral direction H2 by a ball screw mechanism 40A provided between the intermediate plate 41 and the first basal surface 20; and a slide plate 42 that is shiftable to any desired position in the top-bottom direction H3 by a ball screw mechanism 40B provided between the slide plate 42 and the intermediate plate 41. The slide plate 42 functions as the output part of the first XY table 40.

Specifically, as shown in FIG. 5, at the first basal surface 20 of the base plate 13, a driving part receiving groove 43 and a pair of supporting part receiving grooves 44 are formed. The driving part receiving groove 43 extends from the position near the rotary support part 13J to the tip of the lateral projecting part 13T of the base plate 13. The driving part receiving groove 43 is formed of a nut receiving part 43A and a mount receiving part 43B that are identical to each other in width and different from each other in depth. The nut receiving part 43A is deeper than the mount receiving part 43B and formed to extend from the left end to the position near the right end of the driving part receiving groove 43, and the shallower mount receiving part 43B is formed to occupy the rest of the driving part receiving groove 43. The supporting part receiving grooves 44 are shallower than the mount receiving part 43B, and extend from the tip of the lateral projecting part 13T to the position immediately above and below the rotary support part 13J, respectively. The nut receiving part 43A may penetrate the base plate 13 in the front-rear direction.

At the bottom surface of each of the supporting part receiving grooves 44, a slide rail 45 is fixed to the center in the width direction. With each slide rail 45, a pair of sliders 45S slidably engages. The sliders 45S project frontward than the first basal surface 20. To the sliders 45S, the intermediate plate 41 is fixed.

A rotary mount 46B projects from the mount receiving part 43B in the driving part receiving groove 43. The rotary mount 46B rotatably supports one end of a ball screw 48A. The ball screw 48A extends from the rotary mount 46B to the nut receiving part 43A. The ball screw 48A screws with a ball nut 48B, to structure the ball screw mechanism 40A. On the tip surface of the lateral projecting part 13T of the base plate 13, a servomotor 47 is mounted so as to close the end opening of the driving part receiving groove 43 via a bracket 46A. The rotary output shaft of the servomotor 47 is integrally rotatably connected to the ball screw 48A.

Figure 6:
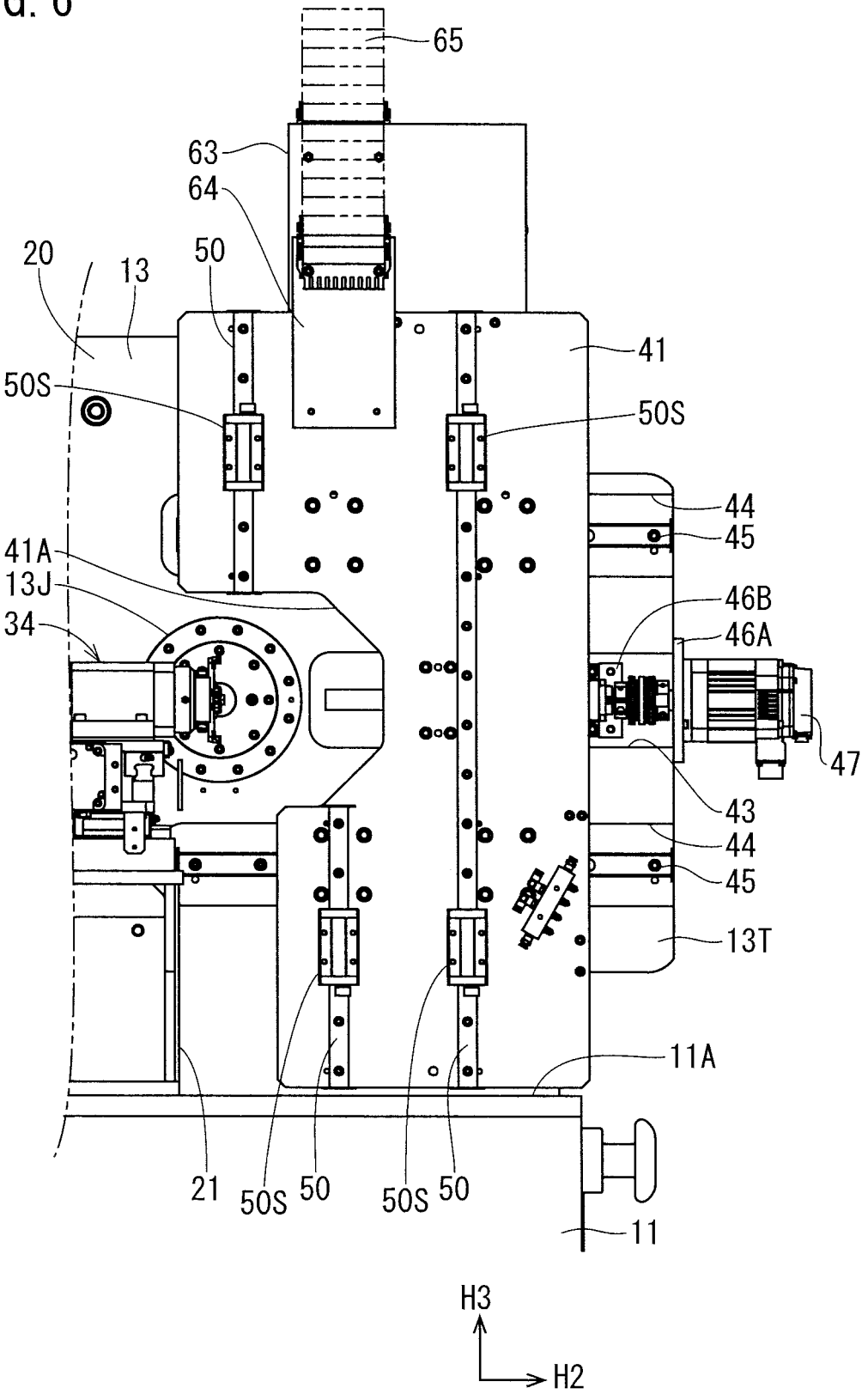
FIG. 6 is a front view of an intermediate plate.

The above-described plurality of sliders 45S and the ball nut 48B are fixed to the rear surface of the intermediate plate 41 shown in FIG. 6. Thus, the intermediate plate 41 shifts to any desired position in the lateral direction H2. The intermediate plate 41 includes a recessed part 41A at the substantial center in the left side of a rectangle elongated in the top-bottom direction H3. The portion upper than the recessed part 41A projects leftward than the portion lower than the recessed part 41A. The recessed part 41A has the shape corresponding to one of halves of a vertically divided right octagon greater than the rotary support part 13J. The upper edge and the lower edge of the recessed part 41A extend in the lateral direction H2. The lower end of the intermediate plate 41 is adjacent to the upper surface 11A of the first mount 11 with a slight clearance. The upper part of the intermediate plate 41 is positioned slightly higher than the base plate 13.

To the intermediate plate 41, support rails 50 extending in the top-bottom direction H3 are respectively fixed at three positions, namely, the rightward position, and the upper and lower portions relative to the recessed part 41A. The support rail 50 on the rightward side in the intermediate plate 41 extends in the entire top-bottom direction H3 of the intermediate plate 41. The other two support rails 50 extend in the entire top-bottom direction H3, in the upper portion and the lower portion relative to the recessed part 41A, respectively. With the support rails 50, sliders 50S slidably engage.

Figure 7:
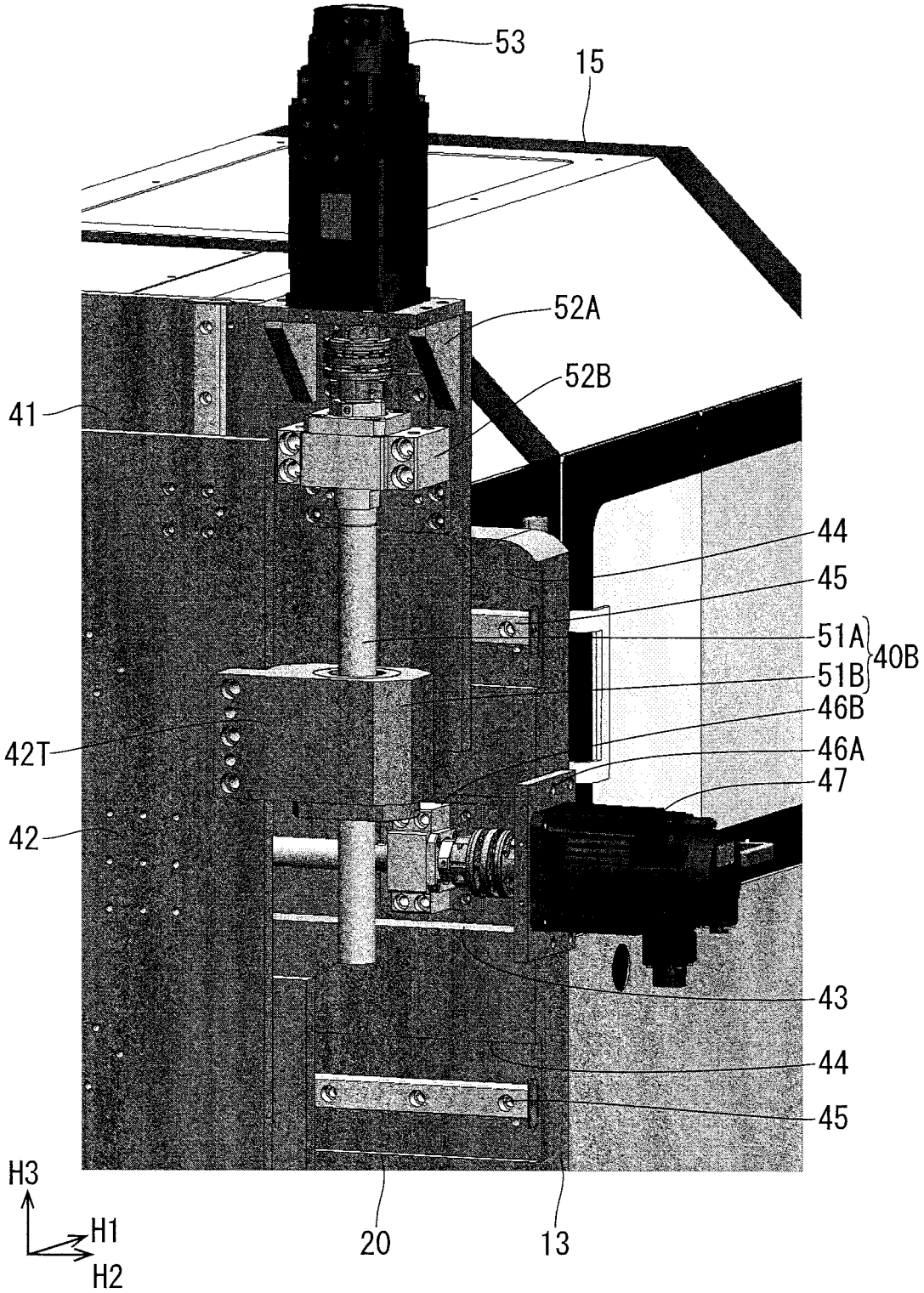
FIG. 7 is a perspective view of a ball screw mechanism between the intermediate plate and a slide plate.

As shown in FIG. 7, at the right part in the front surface of the intermediate plate 41, a bracket 52A extending frontward from the upper end and a rotary mount 52B extending frontward from the position near the upper end are provided. On the upper surface of the bracket 52A, a servomotor 53 is mounted. The rotary mount 52B rotatably supports the upper end of the ball screw 51A extending in the top-bottom direction. The rotary output shaft of the servomotor 53 and the upper end of the ball screw 51A are coupled to each other. A ball nut 51B screws with the portion lower than rotary mount 52B in the ball screw 51A, to structure the ball screw mechanism 40B.

The plurality of sliders 50S are fixed to the rear surface of the slide plate 42 shown in FIG. 8. The ball nut 51B is supported on a nut supporting part 42T extending laterally from the right edge of the slide plate 42. Thus, the slide plate 42 shifts to any desired position in the top-bottom direction H3. Note that, to the bracket 52A (see FIG. 7), a cover 51C having a groove shape is fixed to cover, from the front and both lateral sides, the range from the bracket 52A to the position in the middle of the ball screw 51A.

The slide plate 42 includes a recessed part 42A at the substantial center in the left side of a rectangle elongated in the top-bottom direction H3. The portion upper than the recessed part 42A projects leftward than the portion lower than the recessed part 42A. The upper and lower right corner parts are diagonally cut off. The recessed part 42A of the slide plate 42 has the shape corresponding to a quadrangle having its corners rounded. The depth in the lateral direction H2 of the recessed part 42A is identical to that of the recessed part 41A of the intermediate plate 41, and the height thereof is greater than that of the recessed part 41A of the intermediate plate 41. The entire length in the top-bottom direction H3 of the slide plate 42 is smaller than that of the intermediate plate 41. The width of the portion upper than the recessed part 42A and the width of the portion lower than the recessed part 42A in the slide plate 42 are identical to the width of the portion upper than the recessed part 41A and the width of the portion lower than the recessed part 41A in the intermediate plate 41. As seen in a front view, the right side of the slide plate 42 and the right side of the intermediate plate 41 are overlapped with each other, and the vertical side on the depth side of the recessed part 42A of the slide plate 42 and the vertical side on the depth side of the recessed part 41A of the intermediate plate 41 are overlapped with each other.

Figure 10:
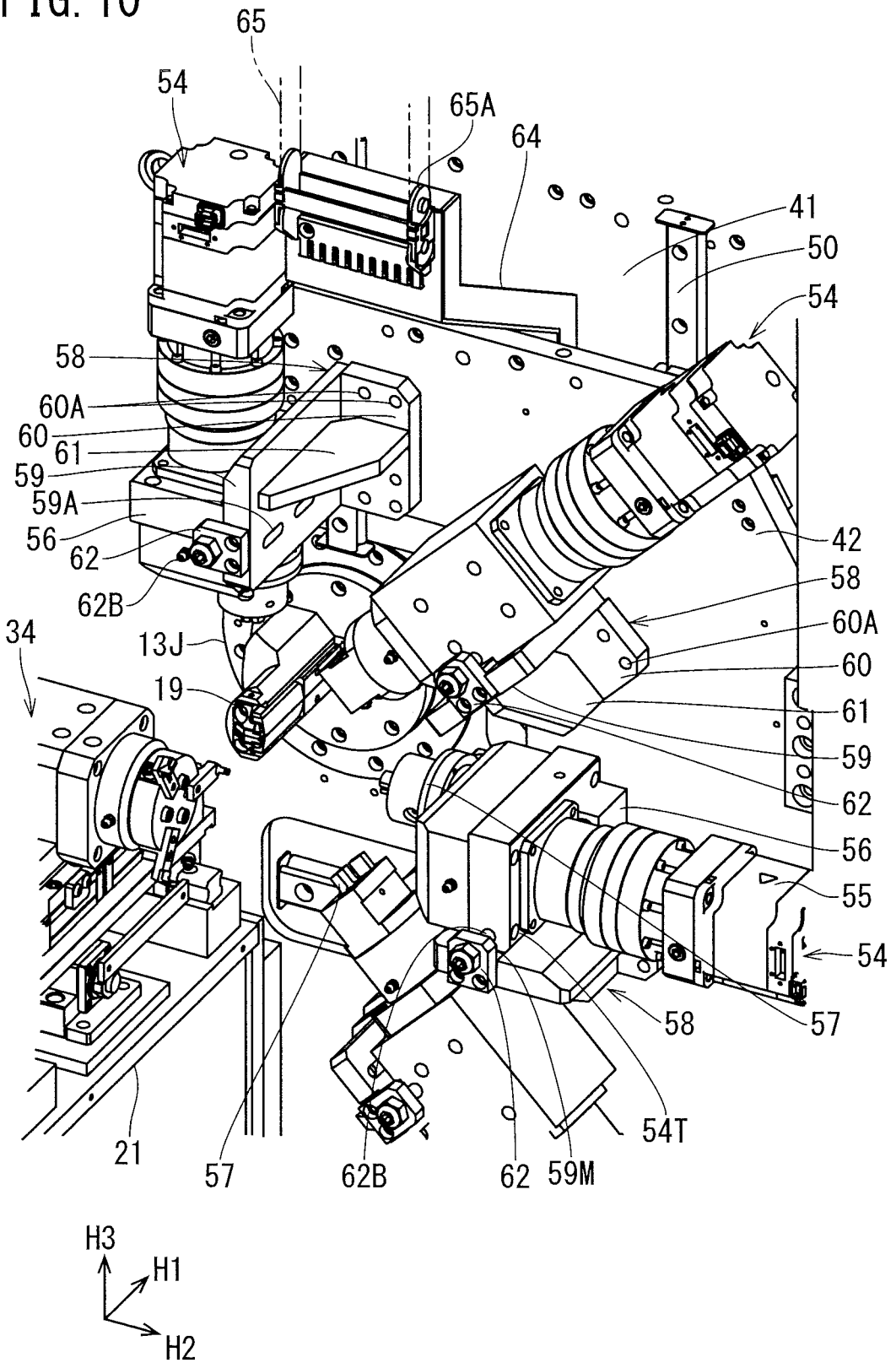
FIG. 10 is a partial perspective view of the wire rod forming machine.

The slide plate 42 is provided with a plurality of apparatus fixing parts 70 for fixing a plurality of first tool shifting apparatuses 54. As shown in FIG. 10, each first tool shifting apparatus 54 includes a deceleration mechanism part 56 at one end of a servomotor 55. To the output rotary part of the deceleration mechanism part 56, a tool 57 is fixed.

Each first tool shifting apparatus 54 is fixed to the apparatus fixing part 70 of the slide plate 42 via a bracket 58. The bracket 58 is structured by, for example, first and second plate parts 59, 60 being perpendicular to each other to be L-shaped, and a rib 61 disposed across the first and second plate parts 59, 60. The second plate part 60 is provided with a plurality of mount holes 60A. Corresponding to the plurality of mount holes 60A, each apparatus fixing part 70 of the slide plate 42 is provided with a plurality of screw holes 70A (see FIG. 8). Such apparatus fixing parts 70 are dispersedly disposed at a plurality of locations at the opening edge of the recessed part 42A in the slide plate 42. The second plate part 60 of the bracket 58 is overlaid on any one of or a plurality of apparatus fixing parts 70, and fixed by bolts inserted into the mount holes 60A. This sets the first plate part 59 of the bracket 58 to be projected frontward from the slide plate 42.

The first plate part 59 is provided with a rectangle groove 59M extending in the front-rear direction H1 on the side opposite to the rib 61. Next to the rectangle groove 59M, a plurality of long holes 59A extending in the front-rear direction H1 are formed. To the tip of the first plate part 59, a plate member 62 is fixed so as to close the end opening of the rectangle groove 59M. The plate member 62 projects from the first plate part 59 on the side opposite to the rib 61. At the projecting portion of the plate member 62, a not-shown screw hole is formed for an adjustment bolt 62B to screw with.

On the other hand, at the side surface of the first tool shifting apparatus 54 (specifically, the side surface of the deceleration mechanism part 56), a side-surface protruding part 54T having a quadrangular cross section is formed. A not-shown plurality of screw holes are formed beside the side-surface protruding part 54T. The side-surface protruding part 54T slidably engages with the rectangle groove 59M of the bracket 58. The adjustment bolt 62B shifts the first tool shifting apparatus 54 to any desired position in the longitudinal direction of the rectangle groove 59M. A bolt inserted into the long hole 59A fixes the first tool shifting apparatus 54 to the first plate part 59.

FIG. 9 shows the state where the brackets 58 are respectively fixed to all the apparatus fixing parts 70, and the first tool shifting apparatuses 54 are respectively fixed to all the brackets 58. As shown in FIG. 9, the plurality of first tool shifting apparatuses 54 are radially arranged. The plurality of brackets 58 are arranged such that, for example, the rotation axes of their respective tools 57 cross at one point when the wire rod forming machine 10 is seen from the front side. More specifically, the apparatus fixing parts 70 are provided, for example, at each of the upper and lower sides of the recessed part 42A in the slide plate 42 and two locations beside the recessed part 42A. The rotation axis of the first tool shifting apparatus 54 mounted on the uppermost apparatus fixing part 70 extends in the top-bottom direction H3. The rotation axis of the first tool shifting apparatus 54 mounted on the third highest apparatus fixing part 70 extends in the lateral direction H2. The rotation axes of the first tool shifting apparatuses 54 mounted on the second highest and the lowermost apparatus fixing parts 70 are inclined at an angle of 45 degrees relative to the lateral direction H2.

Note that, while each first tool shifting apparatus 54 rotationally shiftably holds the tool 57, each first tool shifting apparatus 54 may linearly shift the tool 57 in parallel to the first basal surface 20. Similarly to the second tool shifting apparatus 34, each first tool shifting apparatus 54 may also be provided with a plurality of servomotors so as to separately drive a plurality of tools.

As shown in FIG. 1, from the upper edge of the intermediate plate 41, a cable supporting plate 63 projects upward. From the upper edge of the slide plate 42, a cable supporting bracket 64 projects upward. The cable supporting plate 63 has its lower end overlaid and fixed onto the upper part in the rear surface of the intermediate plate 41. The cable supporting bracket 64 is bent in a crank shape. The cable supporting bracket 64 has its lower end overlaid and fixed onto the upper part in the rear surface of the slide plate 42, and has its upper end positioned in front of the slide plate 42. As shown in FIG. 9, the cable supporting plate 63 is greater than the cable supporting bracket 64 in the lateral direction H2, and disposed such that the cable supporting bracket 64 opposes to the left portion of the cable supporting plate 63. To the upper part in the front surface of the cable supporting bracket 64 and the left portion of the upper part in the rear surface of the cable supporting plate 63, one end and other end of a cable guide 65 of a caterpillar structure are fixed. More specifically, the cable guide 65 is formed of a plurality of rotatably coupled caterpillar elements 65A. The caterpillar elements 65A have a flat frame shape as shown in FIG. 10. The cables of the servomotors 55 of the first tool shifting apparatuses 54 are passed through the caterpillar elements 65A of the cable guide 65 and guided to the rear side of the cable supporting plate 63.

As shown in FIG. 2, from the rear surface of the cable supporting plate 63, a cable mount 66 projects horizontally. From the upper part in the right side surface of the base plate 13, a cable mount 67 projects rightward horizontally. The rear halves of the cable mounts 66, 67 project rearward than the base plate 13. The both ends of a cable guide 68 having the structure identical to the above-described cable guide 65 are fixed to the cable mounts 66, 67. Into the cable guide 68, the cables of the servomotors 55 are passed through and guided to the rear side of the base plate 13. The cables are connected to a not-shown controller of the wire rod forming machine 10.

The foregoing is the description of the structure of the wire rod forming machine 10 according to the present embodiment. Next, a description will be given of the operation and effect of the wire rod forming machine 10. In the wire rod forming machine 10 according to the present embodiment, the wire rod 90 may be formed using just the first tool shifting apparatuses 54 supported on the first XY table 40. Alternatively, the wire rod 90 may be formed using just the second tool shifting apparatus 34 supported on the second XY table 24. Furthermore, the wire rod 90 may be formed using both of them. Thus, the wire rod forming machine 10 according to the present embodiment can form a wire rod product of any of various shapes. Here, the slide plate 42 included in the output part of the first XY table 40 includes, on one lateral part, the recessed part 42A configured to receive the quill 19, and the plurality of apparatus fixing parts 70 for fixing the plurality of first tool shifting apparatuses 54 radially arranged about the recessed part 42A. Thus, the number of tool shifting apparatuses, that is, the number of the movable axes of the tools of the wire rod forming machine 10 is readily changeable. Additionally, despite the increased number of the movable axes of the tools, the whole wire rod forming machine 10 can be compact.

Furthermore, in the wire rod forming machine 10 according to the present embodiment, the base plate 13 is provided with the driving part receiving groove 43 configured to receive the ball screw mechanism 40A for sliding the intermediate plate 41 in the first XY table 40 relative to the base plate 13. This contributes to reducing the thickness of the first XY table 40 in the front-rear direction. Additionally, the ball nut 51B of the ball screw mechanism 40B for sliding the slide plate 42 in the first XY table 40 relative to the intermediate plate 41 is supported by the nut supporting part 42T laterally extending from the outer edge of the base plate 13. This also contributes to reducing the thickness of the first XY table 40 in the front-rear direction. Thus, the compact wire rod forming machine 10 is provided.

On the other side with reference to the quill 19 in a second direction (that is, on the side opposite to the extending supporting part 21), the slide plate 42 covers the first basal surface 20 across one side and the other side with reference to the quill 19 in a first direction. This allows the slide plate 42 to be great in size making full use of the region on the front side of the base plate 13. This allows increasing the number of the first tool shifting apparatuses 54 that can be mounted on the base plate 13.

Furthermore, in the wire rod forming machine 10, the movable direction of the output part (the intermediate plate 41) by the ball screw mechanism 40A included in the first XY table 40 and the movable direction of the output part (the intermediate table 26) by the ball screw mechanism 24A included in the second XY table 24 agree with each other. This contributes to simplifying the control configuration.

The extending supporting part 21 is fixed to the position near one end in the lateral direction H2 in the first basal surface 20 and near the lower end in the top-bottom direction. The second basal surface 23 is oriented upward and horizontally provided. Therefore, the region horizontally next to the extending supporting part 21 can be used as the region for forming the wire rod 90. This improves visibility of the region where the wire rod 90 is formed in exerting the teaching-playback control, thereby facilitating the teaching work. Furthermore, the extending supporting part 21 is stabilized by being supported also from beneath by the first mount 11. This stabilizes the operation of the second tool shifting apparatus 34 on the second XY table 24.

Note that, in the present embodiment, the lateral direction H2 which is the horizontal direction corresponds to "the first direction" in the scope of claims. The top-bottom direction H3 which is the vertical direction corresponds to "the second direction" in the scope of claims. Here, "the first direction" is not specified to the horizontal direction, and may be the vertical direction or an inclined direction relative to the horizontal direction and the vertical direction.

In the embodiment, while the driving part receiving groove 43 configured to receive the ball screw mechanism 40A is provided at the base plate 13, the driving part receiving groove configured to receive the ball screw mechanism 40B may be provided also at the intermediate plate 41. Alternatively, the driving part receiving groove 43 may be provided only to the intermediate plate 41. Furthermore, in the embodiment, while the nut supporting part 42T extends from the slide plate 42 and the ball screw mechanism 40A is provided next to the movable region of the slide plate 42, the nut supporting part may be provided also at the intermediate plate 41 and the ball screw mechanism 40B may be disposed next to the movable region of the intermediate plate 41. Alternatively, the nut supporting part may be provided only at the intermediate plate 41 and the ball screw mechanism 40B may be provided next to the movable region of the intermediate plate 41.

What is claimed is:

1. A wire rod forming machine comprising:

a base plate including a first basal surface on its front side, the first basal surface being vertical;

a quill projecting from the first basal surface;

a wire rod guide hole penetrating through the quill in a front-rear direction;

a wire rod feeding apparatus provided on a rear side of the base plate and configured to feed a wire rod to the front side of the base plate through the wire rod guide hole;

a first XY table mounted on the first basal surface and including an output part that shifts to any desired position in a first direction and a second direction perpendicular to each other within a plane parallel to the first basal surface, wherein the first direction is a horizontal direction and the second direction is a top-bottom direction;

a slide plate that functions as the output part of the first XY table and that is parallel to the first basal surface, on one side in the first direction relative to the quill, the slide plate covering the first basal surface across one side in the second direction and another side in the second direction relative to the quill, and on another side relative to the quill in the first direction, the slide plate not covering the first basal surface at least on the one side in the second direction relative to the quill, the slide plate including a recessed part configured to receive the quill in the first direction;

a plurality of apparatus fixing parts configured to fix a plurality of first tool shifting apparatuses arranged radially about the recessed part to the slide plate, the first tool shifting apparatuses being configured to rotationally or linearly shift while holding tools;

an extending supporting part fixed to a position near one end in the horizontal direction and near a lower end in the top-bottom direction in the first basal surface, and has the second basal surface oriented upward and horizontally;

a second XY table mounted on the second basal surface and including an output part configured to shift to any desired position in a plane parallel to the second basal surface; and a second tool shifting apparatus mounted on the output part of the second XY table and configured to rotationally or linearly shift while holding a tool; wherein the first XY table includes an intermediate plate between the slide plate and the base plate, and a first ball screw mechanism at a lateral side of the slide plate in the first direction and configured to slide the slide plate in one of the first direction and the second direction relative to the intermediate plate.

2. The wire rod forming machine according to claim 1, wherein one of two movable directions of the output part of the second XY table is parallel to the first direction.

3. The wire rod forming machine according to claim 2, wherein the first direction is a horizontal direction and the second direction is a top-bottom direction, and the extending supporting part is fixed to a position near one end in the horizontal direction and near a lower end in the top-bottom direction in the first basal surface, and has the second basal surface oriented upward and horizontally.

4. The wire rod forming machine according to claim 3 further comprising a mount sharing an upper surface to which the base plate and the extending supporting part are fixed.

5. The wire rod forming machine according to claim 2, wherein the first XY table includes a second ball screw mechanism for sliding the intermediate plate in another of the first direction and the second direction relative to the base plate, and the base plate is provided with a driving part receiving groove configured to receive part of the second ball screw mechanism.

6. The wire rod forming machine according to claim 2, wherein the first XY table includes a second ball screw mechanism for sliding the intermediate plate in another of the first direction and the second direction relative to the base plate, wherein the wire rod forming machine further comprises a nut supporting part extending laterally from an outer edge of the slide plate to support a ball nut included in the first ball screw mechanism.

7. The wire rod forming machine according to claim 1, wherein, on the other side relative to the quill in the second direction, the slide plate covers the first basal surface across the one side and the other side relative to the quill in the first direction.

8. The wire rod forming machine according to claim 7, wherein the first direction is a horizontal direction and the second direction is a top-bottom direction, and the extending supporting part is fixed to a position near one end in the horizontal direction and near a lower end in the top-bottom direction in the first basal surface, and has the second basal surface oriented upward and horizontally.

9. The wire rod forming machine according to claim 8 further comprising a mount sharing an upper surface to which the base plate and the extending supporting part are fixed.

10. The wire rod forming machine according to claim 7, wherein the first XY table includes a second ball screw mechanism for sliding the intermediate plate in another of the first direction and the second direction relative to the base plate, and the base plate is provided with a driving part receiving groove configured to receive part of the second ball screw mechanism.

11. The wire rod forming machine according to claim 7, wherein the first XY table includes a second ball screw mechanism for sliding the intermediate plate in another of the first direction and the second direction relative to the base plate, wherein the wire rod forming machine further comprises a nut supporting part extending laterally from an outer edge of the slide plate to support a ball nut included in the first ball screw mechanism.

12. The wire rod forming machine according to claim 1 further comprising a mount sharing an upper surface to which the base plate and the extending supporting part are fixed.

13. The wire rod forming machine according to claim 12, wherein the first XY table includes a second ball screw mechanism for sliding the intermediate plate in another of the first direction and the second direction relative to the base plate, and the base plate is provided with a driving part receiving groove configured to receive part of the second ball screw mechanism.

14. The wire rod forming machine according to claim 12, wherein the first XY table includes a second ball screw mechanism for sliding the intermediate plate in another of the first direction and the second direction relative to the base plate, wherein the wire rod forming machine further comprises a nut supporting part extending laterally from an outer edge of the slide plate to support a ball nut included in the first ball screw mechanism.

15. The wire rod forming machine according to claim 1, wherein the first XY table includes a second ball screw mechanism for sliding the intermediate plate in another of the first direction and the second direction relative to the base plate, and the base plate is provided with a driving part receiving groove configured to receive part of the second ball screw mechanism.

16. The wire rod forming machine according to claim 13, wherein the wire rod forming machine further comprises a nut supporting part extending laterally from an outer edge of the slide plate to support a ball nut included in the first ball screw mechanism.

17. The wire rod forming machine according to claim 1, wherein the first XY table includes a second ball screw mechanism for sliding the intermediate plate in another of the first direction and the second direction relative to the base plate, wherein the wire rod forming machine further comprises a nut supporting part extending laterally from an outer edge of the slide plate to support a ball nut included in the first ball screw mechanism.

* * * * *